US006140261A

United States Patent [19]

Uhlmann

[11] Patent Number: 6,140,261

[45] Date of Patent: Oct. 31, 2000

[54] PROCEDURE FOR THE MANUFACTURE OF ELASTIC TEXTILE FABRICS

[76] Inventor: Klaus Uhlmann, Bahnhofstrasse 30b, D-82431 Kochel am See, Germany

[21] Appl. No.: 08/926,925

[22] Filed: Sep. 10, 1997

[30] Foreign Application Priority Data

Mar. 10, 1997 [DE] Germany ..... 197 09 706

[51] Int. Cl.[7] ..... D04B 21/12

[52] U.S. Cl. ..... 442/306; 28/155; 66/202; 442/308

[58] Field of Search ..... 442/182, 189, 442/306, 308; 139/426 TW; 28/155; 66/202

[56] References Cited

U.S. PATENT DOCUMENTS

| | | | |
|---|---|---|---|
| 1,874,084 | 8/1932 | Cotchett | 139/426 TW |
| 2,740,183 | 4/1956 | Corbiere | 28/155 |
| 2,807,073 | 9/1957 | Stuewer | 28/155 |
| 3,183,657 | 5/1965 | Corbiere | 25/155 |
| 3,576,703 | 4/1971 | Baker et al. . | |
| 4,892,557 | 1/1990 | Conklin et al. | 139/426 TW |
| 5,382,200 | 1/1995 | Kimoto | 474/260 |

FOREIGN PATENT DOCUMENTS

| | | |
|---|---|---|
| 0 023 932 B1 | 5/1984 | European Pat. Off. . |
| OS 23 21 852 | 11/1974 | Germany . |
| 2 511 505 | 9/1976 | Germany . |
| OS 27 40 046 | 3/1979 | Germany . |
| 28 35 988 C2 | 2/1980 | Germany . |
| 29 28 692 C2 | 2/1981 | Germany . |
| OS 29 28 692 | 2/1981 | Germany . |
| 73-011311 | 12/1966 | Japan . |
| 52-096276 | 8/1977 | Japan . |
| 61-119756 | 6/1986 | Japan . |
| 1 266 135 | 3/1972 | United Kingdom . |

OTHER PUBLICATIONS

M. L. Joseph, Introductory Textile Science, 5th ed., Chapter 17, pp. 169–179 and Chapter 23, pp. 239–255, 1986.

Printout of WPIDS Database, English language abstracts for DE 2321852, EP 23932, DE 2928692, and DE 2740046.

*Primary Examiner*—Terrel Morris
*Assistant Examiner*—Cheryl Juska
*Attorney, Agent, or Firm*—Adams, Schwartz & Evans P.A.

[57] ABSTRACT

A process for imparting permanent elastic properties to fabrics constructed of yarns principally formed of natural, inelastic fibers, the process comprising the steps of spinning a first yarn with Z-twist, spinning a second yarn with S-twist, forming a fabric from the first and second yarns by alternating first and second yarns during fabric formation so that the fabric contains alternate S-twist and Z-twist yarns, shrinking the fabric, and setting the twist in the yarns in the fabric.

9 Claims, No Drawings

PROCEDURE FOR THE MANUFACTURE OF ELASTIC TEXTILE FABRICS

The object of this invention is a procedure for the manufacture of textile fabrics from yarns prepared from natural fibers and/or cellulosic and/or protein fibers.

It is generally accepted that of all the known fibers, or respectively yarns, which are used for the manufacture of textile fabrics, i.e. specifically fabrics used in the clothing industry, natural fibers, e.g cotton, wool, silk or other cellulosic or protein fibers, as well as mixtures of the above listed fibers, are preferred by the wearers because of their pleasant feel on the skin, because of their good breathing properties and their ability to absorb body moisture.

The above mentioned fibers are especially suited for the manufacture of such textile goods which are to be worn directly on the skin, specifically underwear. It is a standard objective for such textile goods to be provided with a permanent stretch-effect which provides for a perfect skin-tight fit even after repeated laundering of the item.

The appearance of synthetic fibers made it possible to solve the heretofore pressing problem of providing textile fabrics with permanent stretch properties. Synthetic fibers, because of their thermoplastic properties, can be reshaped by heating and made elastic by employing such processes as texturizing, the knit-deknit or crinkle procedure, or by stuffer-box texturing or similar processes. Elastic or even highly elasticized textile fabrics produced by such procedures are especially familiar from the hosiery industry.

However, the disadvantages of all these thermoplastic synthetic fibers are also well known; such disadvantages include their lack of skin compatibility, breathability, moisture absorptivity etc. It is for these reasons that efforts have been made to develop corresponding elastification procedures for the natural fibers with their well known skin compatibility, the main objective being to achieve the stretch-based wearability and easy fashioning, characteristic of the pure synthetic fibers. To this effect, the non-elastic natural fibers have been jointly processed with elastic synthetic fibers and yarns, especially the combined use of highly elasticized polyurethane based fibers achieved significant successes.

However, the combined processing of non-elastic natural fibers with highly resilient polyurethane fibers results in significant manufacturing problems, especially so with respect to knitting, warp-knitting and also weaving. Processing problems arise from the different properties of these yarns as they are run on the same machine.

Independent of these technical problems, such blended creations continue to exhibit serious disadvantages resulting from the synthetic fiber components: skin compatibility, breathability and moisture absorptivity are clearly reduced when compared to the natural fibers.

This points to the necessity of searching for procedures to elasticize the natural fibers, which as such are devoid of natural elasticity.

For instance DE-OS 2 321 852 teaches a procedure for the preparation of a yarn with a permanent stretch effect, specifically from protein-containing fibers such as silk, by overtwisting one or more filaments in one twist-direction close to the critical twist-point, to set the twist by either heat or active hydrolysis agents, followed by untwisting the resulting ply-yarn back to the zero twist point or beyond.

After completing this known procedure, the component filaments of the resulting yarn exhibit helical type windings. While such yarns exhibit the desired elastic properties, during further processing on the highly complex machines on which knitting, warp-knitting or weaving is carried out, these yarns also make such processes susceptible to malfunctions.

It is thus the object of this invention, to process natural fiber yarns and other yarns on knitting machines, warp-knitting machines and/or looms, where these yarns did not previously undergo any elastification processes, but where the textile fabric produced by these machines, possibly after undergoing subsequent additional processing steps, exhibits the desired elastic characteristics.

This objective is achieved by knitting, warp-knitting, or weaving with yarns where one filament has been subjected to S-twist, while the other filament was subjected to Z-twist, and both are processed together in opposite twist directions.

It is to be made clear, that it is state of the art knowledge to prepare yarns from natural or other cellulosic or protein fibers by twisting the individual fibers to a thread. The preferred twist direction is the Z-twist, or regular twist, but equally acceptable would be a yarn with the opposite twist direction, an S-twist, this is simply a matter of the control setting of the spinning frame. In order to obtain a satisfactory elastic recovery force for the thread, a defined spinning twist is required. Non-elastic natural fibers, e.g. cotton with a yarn count of Nm 100/1 with normal conventional twist for processing as knitwear for tricot underwear for ladies or gentlemen, are spun in Z-direction with 1100 T/m and further processed on tricot knitting machines. The result is a conventional piece of knitwear, as either single-jersey or rib-fabric, where the ribbing and the change from reverse stitch to plain stitch provides the so called "rib-elasticity" in only a single direction, for example in the width direction of the fabric. For the process characterizing the instant invention, exactly defined spinning twists are required, and these start at higher values than the above mentioned "tricot-twist". At the same time, it is no longer necessary to use extremely high twists, or, indeed, to overtwist close to the so called critical twist point. Nor is it ever a requirement to untwist these threads again and to thus elastify the thread itself. It is critical that the non-elastic filaments are spun with the above defined spinning-twists, but in each case in opposing twist directions, i.e. in S- or respectively Z-twist direction.

The instant invention thus achieves its effect in producing a textile fabric by is deliberately processing two yarns together which have been twisted in opposite directions, with the additional essential requirement that these two yarns be processed in opposing directions to their basic S- or Z-twist direction.

Surprisingly, a processing mode characterized by these specifics results in the creation of a textile fabric which exhibits the desired highly elastic properties, and, in addition, is characterized by a highly uniform appearance.

Experience has demonstrated that the S-twisted yarn should have a at least 5 percent and preferably at least 10% higher twist than the Z-twisted yarn. The reason for the higher twist number for the S-twisted yarn versus the Z-twisted yarn is that this compensates for the opposing direction of rotation of the knitting machine, producing a completely smooth appearance of the loop structure and a uniform piece of knitted goods which cannot loose shape in one direction and does not pucker in the loops. Present state of the art virtually forbade those skilled in the art to process in S- and Z-twist direction, the expectation was to obtain a twisted piece of knitted goods with an unlevel appearance and a good deal of puckering, similar to the appearance of well known crepe style items, where this was desired as a special effect, yet such crepe items were processed with yarn with only one twist direction. For this reason, those skilled in the art rejected any processing in S- and Z-direction for smooth, normal knit goods items. It is of course also possible to use higher spin twists than those mentioned earlier, this results in satisfactory values for the elastic rebound force of the articles. The higher the twist numbers, the better is the elastic recovery.

A further embodiment of the instant invention is that the S- or Z-twisted yarns are processed during knitting with a stitch size which allows a certain distance between the contact points of the S- or Z-twisted yarns so that the yarns have sufficient space to adequately adjust lengthwise.

Such an advantageously chosen stitch size enhances the desired elastic properties of the knitted fabric, i.e. the S- and Z-yarns processed together in opposing twist directions to result in a piece of knit goods are allowed sufficient space within the mesh structure to effectively display their elastic properties. Thus, for knitted goods according to the procedure of the instant invention, stretch is predominantly a function of the length of the loop. Elongation, or respectively longitudinal elasticity, of such knitted goods is a direct function of the length of the loop, the larger the loop length, the higher the elongation.

A further embodiment of the instant invention is to be found in the fact that in woven textile fabrics the S- or Z-twisted yarns, as they are arranged as warp and filling, are maintained at such a distance from each other that the S- or Z-twisted yarns can satisfactorily adjust lengthwise between their points of contact.

In this context, the distance between the filling yarns controls the longitudinal stretch, and the distance between the warp yarns controls the stretch in the width direction.

In order to obtain the above described characteristic effect of this invention with knitted, warp knitted or woven goods, i.e. two-dimensional elasticity of up to 100%, or, in other words, longitudinal and lateral stretchability and elastic recovery in an heretofore unheard of order of magnitude of up to 100%, it is necessary to precisely set the parameters, on a knitting machine for example, and to choose yarn count, machine gauge, needle spacing, sinking depth and loop length in such a way that all are in harmony, allowing for adequate stretch, without resulting in a slack piece of knitted goods with poor appearance, which would not be acceptable in the market place. Thus, to achieve the desired objective of the invention, it is a definite requirement during processing, i.e. the manufacture of textile goods, to maintain exact processing parameters. For the manufacture of knitted goods the following parameters are critical:

Defined yarn counts, matching the respective gauge of the knitting machine, defined stitch settings in thread tension cN, loop lengths ML, the pick count DF, the sinking depth K. Respective details will become obvious from the later examples.

Using the described processing steps according to the instant invention, yarns can be processed by spinning, weaving, knitting or warp knitting to yield elastic two-dimensional textile articles; this elasticity, however, is not yet at the optimum, and especially so far is not yet permanent.

In a further advantageous embodiment of the procedure according to the instant invention, the above described textile articles are subjected to a shrinkage and fixation process, which varies depending on the type of fiber used. This after treatment of the obtained inventive textile article guarantees that, even after long term use and frequent laundering, the article will not loose the desired elastic characteristics. In carrying out this after treatment process, care has to be taken that, with reference to the respectively selected fibers, suitable products are employed which will condense, i.e. shrink, the articles as much as possible, which is then followed by a specific fixation process which assures that after stretching the article will return to this starting state. Only by means of this shrinkage and fixation process are the final permanent elastic properties and wash-fastness obtained, which are required for the performance characteristics of the finished textile goods fashioned from the articles.

The procedures and products employed are different for the respective natural fibers. For the group of cellulosic fibers, such as cotton, spun rayon yarn, viscose rayon, Tencel®, Lyocell, suitable wetting and scouring agents combined with an alkali treatment are likely candidates; these agents are employed by themselves, or combined with a subsequent fixation treatment, using suitable products, e.g. resin finishes or the like.

To reinforce the shrinkage and fixation process, a direct subsequent bleaching process may be added, which in turn can also be directly followed by a dyeing step. A bleaching or dyeing step, or both following each other, additionally reinforce this shrinkage and fixation process. All bleaching and dyeing procedures suitable for cellulosic fibers may be employed.

For the protein fibers, i.e. wool, silk etc., products and procedures suitable to this fiber group are employed. For splitting the cysteine- and disulfide-bonds and for fixation, products based on ammonium alkanol sulfonates (Siroset® FW or the like), Carbamides or similar, as well as steam and hydrolytically active agents are used.

The following procedure has been found effective for the shrinkage and fixation treatment of cotton: prior to the normal bleach, pre-bleach and dyeing steps by the usual procedures employed for cotton, e.g. substantive or reactive dyeing etc., the goods are treated with the following products in a dyeing apparatus: wetting agents based on a rapid wetting agent (Perenin® AS), a scouring agent to remove the natural cotton waxes and contaminations (alkylpolyglycol ether, e.g. fatty alcohol polyglycol ethers, such as Perenin® G 392, or Solpon® 4488) and approximately 3–5 ml/l of 50% NaOH, depending on the weight and density of the article; treatment is to be at the boil for 30–60 min., combined with a suitable product which counteracts the hardening and stiffening of the cellulosic fiber. Fiber stiffness does not allow for elastic characteristics of the goods.

The above described shrinkage and fixation process and the subsequent finishing procedures, such as bleach, pre-bleach, dyeing and finish treatments can be efficiently carried out in the same dyeing apparatus. This allows for the specific possibility of manufacturing budget priced marketable finished goods. It is thus possible for the first time to offer natural fiber based textile articles, prepared according to the procedure of this invention, at market sensitive price levels. For instance, in comparison with cotton knit-ware prepared from cotton and Elastan (polyurethane basis), cotton knit-ware manufactured according to this invention features a manufactured price between normal non-elastic cotton and the above mentioned cotton/Elastan combination. If the known previously mentioned manufacturing problems for cotton/Elastan blends and the high scrap percentage caused by the Elastan component are taken into account, the procedure according to this invention provides a clear price advantage for cotton knit-ware.

As previously mentioned, in order to maintain the elasticity of the natural fiber articles, the hardening and stiffening of the fibers, which normally occur during the conventional finishing processes in aqueous media, must be avoided. In order to maintain the goods in a flexible state during the wet-processing procedures, the addition of suitable products, e.g. polycarboxylic acid derivatives (Tebolan® UF) is required. In addition, special processing steps, such as slow cooling after thermal treatments, can also be incorporated.

A further increase of the elastic properties, after the finishing processes, can be achieved by a Final-finish step which provides suppleness and smoothness to the fibers and yarns. Especially surface smoothness of the yarns allows the loops to "slip" and markedly enhances the stretch effect. For cotton, this effect is obtained by using two different fatty substances. The natural fatty substances and waxes of cotton, which have been removed by the shrinkage process and the subsequent finishing procedures, are replaced by such products as quaternary fatty acyl ammonium compounds (Bethamin® GFL), and the surface smoothness of the cotton fiber is restored by a finish with smoothing compounds such as modified polysiloxane emulsions (Viscosil® CSI). These treatments are also carried out in the same dyeing apparatus and are referred to as after-softening treatments.

While the procedure according to this invention applies exclusively to natural, cellulosic and/or protein fibers, a synthetic fiber may be co-processed if this is desired for special reasons.

In the following we provide two examples: a) the manufacture of a highly elastic smooth Single-Jersey, and b) the preparation of a highly elastic circular fabric.

EXAMPLE 1

Manufacture of a knitted cotton fabric a) Spinning

Cotton Nm 60/1 PP extra long staple, combed (Egyptian maco cotton) is spun on a ring spinning frame at the following settings 1200 T/m Z-twist=1 yarn 1260 T/m S-Twist=1 yarn b) Knitting These yarns are processed on a tricot knitting machine—knitting program: Single-Jersey smooth Manufacturer: Mayer & Cie Type MV 411

Diameter: 26 inches

Gauge: 2268 needles

Needle spacing: 0.99 mm

Machine settings

| T-tex | T-Nm | T-Ne | ML | DF | K | Qual. |
|---|---|---|---|---|---|---|
| 16.7 | 60 | 36 | 0.284 | 14.4 | 1.8 | 200 |

where:

T-tex=yarn count in tex

T-Nm=yarn count in Nm

T-Ne=yarn count in Ne

ML loop length

DF=pick count in $tex^{1/2}/cm$

K=sinking depth in mm c) Shrinking- and Fixation Process

The piece of knit goods is subjected to a shrinkage and fixation process in a Then-Overflow dyeing apparatus:

Liquor Ratio 1:15

Formulation 1 g/l Perenin® G 392

0.5 g/l Perenin® AS 1 g/l Delinol® VB 1 g/l Tebolan® WF

The piece of knit goods is treated in this liquor at a temperature of 30–40° C. for ten minutes, then 3 ml/l of 50% NaOH are added, the liquor temperature increased to 98° C. and treatment continued for approximately 30 minutes. This is followed by a hot rinse and then a warm rinse. The piece is then neutralized to pH 7 with acetic acid.

This is then followed by a pre-bleach procedure and a dyeing step with reactive dyes by conventional procedures.

This is followed by the Final-finish process for smoothness, carried out with:

3% by wt. of goods Bethamin® GFL

1% by wt. of goods Viscosil® CSI pH 5.5 with acetic acid

The piece of knit goods is treated with the above preparation for 15 minutes at 30–40° C., hydroextracted and dried.

All wet processing steps should be carried out as tension-free as possible.

The final product is a piece of knitted goods with longitudinal and lateral elasticity in the range of 80–100% stretch with excellent elastic recovery force.

EXAMPLE 2

Preparation of a highly elastic circular fabric, for instance for the manufacture of stockings or panty hose:

a) Spinning

Cotton yarn Nm 60/1 is spun with 1200 T/m Z-twist and 1320 T/m S-twist.

b) Knitting

This yarn is knitted as a double-thread on a circular knitting machine, 3¾ inch, 15 feed, plain knitting feed, without rib.

c) Shrinkage and Fixation

In a dyeing apparatus the circular knitted fabric is subjected to a shrinkage and fixation process in the following soft-water based liquor:

1 g/l Perenin® G 392

1 g/l Tebolan® UFN 1 g/l Delinol® 9208

The knitted socks are treated in the above liquor at 30–40° C. for 10 minutes. Then 3 ml/l of 50% NaOH are added and the temperature is increased to 98° C., treatment continues for 30 minutes.

Next follows a bleaching step with 2 g/l of Cerafil® BFA, 1 g/l Tebolan® UFN and 3 ml/l 35% $H_2O_2$. The knitted pieces are treated in this liquor at 98° C. for 30 minutes, then an additional 1.5 ml/l 35% $H_2O_2$ is added and treatment continued under the same conditions for an additional 20 minutes. This is followed by a hot and warm rinse at pH 7 (acetic acid).

The final step is an exhaust procedure, using 3% by wt. of goods of Bethamin® GFL and 1% by wt. of goods of Viscosil® CSI. The pH is adjusted to 5.5 with acetic acid and treatment proceeds at 30–40° C. for 15 minutes, this is followed by a brief hydroextraction step and drying.

The end result are circular knitted fabrics (knitted socks) with a longitudinal elasticity of 120% and a lateral elasticity of 90% and excellent elastic recovery force.

The products characterized with ®, listed in the above descriptive sections and the examples, are trademarked products of the following companies:

| Product | Manufacturer | Chemical Nature |
|---|---|---|
| Perenin AS | Dr. Th. Böhme KG Chem. Fabrik GmbH & Co. | Sulfonated dicarboxylic acid ester |
| Perenin G 392 | Dr. Th. Böhme KG Chem. Fabrik GmbH & Co. | Alkylpolyglcolether |
| Solpol 4488 BA | Dr. Th. Böhme KG Chem. Fabrik GmbH & Co. | Fatty alcohol polyglycol ether |
| Delinol VB | Dr. Th. Böhme KG Chem. Fabrik GmbH & Co. | Polyacrylic acid salt |
| Delinol 9208 | Dr. Th. Böhme KG Chem. | Organic polymer compd. |
| Tebolan UFN | Dr. Th. Böhme KG Chem. Fabrik GmbH & Co. | Polycarboxylic acid derivative |
| Cerafil BFA | Dr. Th. Böhme KG Chem. Fabrik GmbH & Co. | Mixture of phosphoric acid ester and alkyl aryl sulfonate |
| Bethamin GFL | Dr. Th. Böhme KG Chem. Fabrik GmbH & Co. | Quaternary fatty acyl ammonium compound |
| Viscosil CSI | Dr. Th. Böhme KG Chem. Fabrik GmbH & Co. | Emulsion of modified polysiloxanes |
| Sircoset FW | Dr. Th. Böhme KG Chem. Fabrik GmbH & Co. | Substituted ammonium alkanol sulfonates |
| Tencel | Courtaulds Co. | a cellulosic fiber |

I claim:

1. A process for imparting permanent elastic properties to fabrics constructed of yarns principally formed of natural, inelastic fibers, said process comprising the steps of:

(a) spinning a first yarn with Z-twist;

(b) spinning a second yarn with S-twist;

(c) knitting a fabric from the first and second yarns by alternating first and second yarns during fabric formation so that the fabric contains alternate S-twist and Z-twist yarns, wherein said natural fiber comprises cotton and further wherein the spinning steps comprise placing at least five percent more twist in the S-twist yarns than in the Z-twist yarn; and (d) shrinking and setting the twist in the fabric.

2. A process according to claim 1, wherein the knitting step comprises circular knitting.

3. A process according to claim 1, wherein the knitting step comprises warp knitting.

4. A process for imparting permanent elastic properties to fabrics constructed of natural, inelastic yarns, comprising the steps of:

(a) knitting a fabric having a first yarn spun with a Z-twist and a second yarn spun with a S-twist by alternating the first and second yarns during fabric formation so that the fabric contains alternating S-twist and Z-twist yarns, wherein the S-twist yarn has at least 5 percent greater twist than the Z-twist yarn;

(b) processing the S-twist and the Z-twist yarns during fabric formation so that the distance between contact points of the S-twist and Z-twist yarns enable the yarns to adjust in the length-wise direction between said contact points; and (c) shrinking and fixing the fabric.

5. A process according to claim 4, and including the additional step of bleaching the fabric.

6. A process according to claim 5, and including the additional step of dyeing the fabric.

7. A process according to claim 6, wherein the fabric includes one or more synthetic fibers.

8. A fabric formed according to the process of claims 4, 6 or 7.

9. A fabric formed according to the process of claim 5.

* * * * *